US010964253B2

(12) United States Patent
Lim et al.

(10) Patent No.: US 10,964,253 B2
(45) Date of Patent: Mar. 30, 2021

(54) PIXEL INCLUDING LIGHT-EMITTING DEVICES AND DISPLAY DEVICE INCLUDING THE PIXEL

(71) Applicant: Samsung Display Co., Ltd., Yongin-Si (KR)

(72) Inventors: Jaekeun Lim, Yongin-si (KR); Jeongkyoo Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/546,205

(22) Filed: Aug. 20, 2019

(65) Prior Publication Data

US 2020/0111410 A1 Apr. 9, 2020

(30) Foreign Application Priority Data

Oct. 5, 2018 (KR) ..... 10-2018-0119300

(51) Int. Cl.
*G09G 3/32* (2016.01)

(52) U.S. Cl.
CPC ..... *G09G 3/32* (2013.01); *G09G 2300/0809* (2013.01); *G09G 2320/0233* (2013.01); *G09G 2320/0626* (2013.01)

(58) Field of Classification Search
CPC ..... G09G 2300/0861; G09G 3/3233; G09G 2310/0256; G09G 3/3291; G09G 2300/0804; G09G 3/3258; G09G 3/3266; G09G 3/32
See application file for complete search history.

(56) References Cited

U.S. PATENT DOCUMENTS

| | | | | |
|---|---|---|---|---|
| 9,589,504 | B2 | 3/2017 | Qing et al. | |
| 9,881,544 | B2 | 1/2018 | Qing et al. | |
| 2011/0089850 | A1 | 4/2011 | Shibata et al. | |
| 2015/0287359 | A1* | 10/2015 | Qing | G09G 3/3258 345/214 |
| 2015/0364076 | A1* | 12/2015 | Park | G09G 3/2081 345/77 |
| 2016/0125800 | A1* | 5/2016 | Kim | G09G 3/3208 345/212 |
| 2017/0148389 | A1* | 5/2017 | Zhou | G09G 3/3233 |

(Continued)

FOREIGN PATENT DOCUMENTS

| | | | |
|---|---|---|---|
| JP | 2011-103435 | A | 5/2011 |
| KR | 10-2018-0009014 | A | 1/2018 |
| KR | 10-2018-0055021 | A | 5/2018 |

*Primary Examiner* — Gerald Johnson
(74) *Attorney, Agent, or Firm* — Lewis Roca Rothgerber Christie LLP

(57) ABSTRACT

Each of pixels of a display device includes: a light-emitting portion including first light-emitting devices that are connected in a forward direction between a first electrode and a second electrode and second light-emitting devices that are connected in a reverse direction between the first electrode and the second electrode; a pixel circuit configured to receive a data voltage in synchronization with a scan signal, generate a driving current based on the data voltage, and output the driving current to a first node; and a light-emitting circuit configured to be controlled by a control signal, provide the driving current to the first light-emitting devices during a first emission period, and provide the driving current to the second light-emitting devices during a second emission period.

20 Claims, 12 Drawing Sheets

(56) References Cited

U.S. PATENT DOCUMENTS

| | | | | |
|---|---|---|---|---|
| 2018/0019377 | A1 | 1/2018 | Kim et al. | |
| 2018/0138157 | A1 | 5/2018 | Im et al. | |
| 2019/0103060 | A1* | 4/2019 | Kang | H01L 51/5206 |
| 2019/0305000 | A1* | 10/2019 | Lin | H01L 25/167 |

* cited by examiner (b)

PIXEL INCLUDING LIGHT-EMITTING DEVICES AND DISPLAY DEVICE INCLUDING THE PIXEL

CROSS-REFERENCE TO RELATED APPLICATION

This application claims the benefit of and priority to Korean Patent Application No. 10-2018-0119300, filed on Oct. 5, 2018, in the Korean Intellectual Property Office, the disclosure of which is incorporated herein in its entirety by reference.

BACKGROUND

1. Field

One or more embodiments of the present disclosure relate to a pixel and a display device, and more particularly, to a pixel and a display device, each including a micro light-emitting diode (LED).

2. Description of the Related Art

A light-emitting device such as a light-emitting diode (LED) has high light conversion efficiency, very low energy consumption, and a semi-permanent lifespan, and is environmentally friendly. To use an LED in a lighting device or a display device, it is required that an LED be connected between a pair of electrodes that may apply power to the LED. An LED may be connected to electrodes in various forms and methods, for example, by directly growing LEDs on a pair of electrodes and separately growing LEDs and then arranging the LEDs on electrodes. In the latter case, in the case where the LEDs are nano- or micro-sized LEDs, it is difficult to arrange the LEDs on the electrodes. In addition, since the LEDs have polarity, it is difficult to arrange the LEDs between the electrodes according to the polarity.

SUMMARY

One or more embodiments of the present disclosure include a display device that is capable of emitting light with uniform luminance in a pixel unit despite of non-uniformity of a ratio, in which independently manufactured micro light-emitting diodes (LEDs) are arranged in a forward direction between a pair of electrodes.

One or more embodiments include a pixel that is capable of emitting light from micro LEDs arranged in a reverse direction between a pair of electrodes, as well as micro LEDs arranged in a forward direction between a pair of electrodes.

Additional aspects of the present disclosure will be set forth in part in the following description and, in part, will be apparent from the description, or may be learned by practice of the exemplary embodiments disclosed herein.

According to one or more embodiments, a display device includes: a display unit including a plurality of pixels arranged in a first direction and a second direction; a scan driver configured to transmit scan signals to the plurality of pixels through a plurality of scan lines; a data driver configured to transmit data voltages to the plurality of pixels through a plurality of data lines; a control driver configured to transmit a control signal to the plurality of pixels through a control line; and a voltage generator configured to supply a first driving voltage and a second driving voltage to the plurality of pixels through a first power supply line and a second power supply line, respectively.

Each of the pixels includes: a light-emitting portion including first light-emitting devices that are connected in a forward direction between a first electrode and a second electrode and second light-emitting devices that are connected in a reverse direction between the first electrode and the second electrode; a pixel circuit configured to receive a corresponding data voltage among the data voltages in synchronization with a corresponding scan signal among the scan signals, generate a driving current based on the corresponding data voltage, and output the driving current to a first node; and a light-emitting circuit configured to be controlled by the control signal, provide the driving current to the first light-emitting devices during a first emission period, and provide the driving current to the second light-emitting devices during a second emission period.

According to one or more embodiments, a pixel is connected to a scan line for receiving a scan signal, a data line for receiving a data voltage, a control line for receiving a control signal, a first power supply line for receiving a first driving voltage, and a second power supply line for receiving a second driving voltage. The pixel includes a light-emitting portion including first light-emitting devices that are connected in a forward direction between a first electrode and a second electrode and second light-emitting devices that are connected in a reverse direction between the first electrode and the second electrode; a pixel circuit configured to receive the data voltage in synchronization with the scan signal, generate a driving current from the first driving voltage supplied from the first power supply line based on the data voltage, and output the driving current to a first node; and a light-emitting circuit configured to be controlled by the control signal, provide the driving current to the first light-emitting devices during a first emission period, and provide the driving current to the second light-emitting devices during a second emission period, the light-emitting circuit being connected to the first and second electrodes, the first node, the second power supply line, and the control line.

Aspects, features, and advantages other than the aforementioned descriptions may be understood more readily by reference to the following accompanying drawings, claims, and detailed descriptions of exemplary embodiments.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
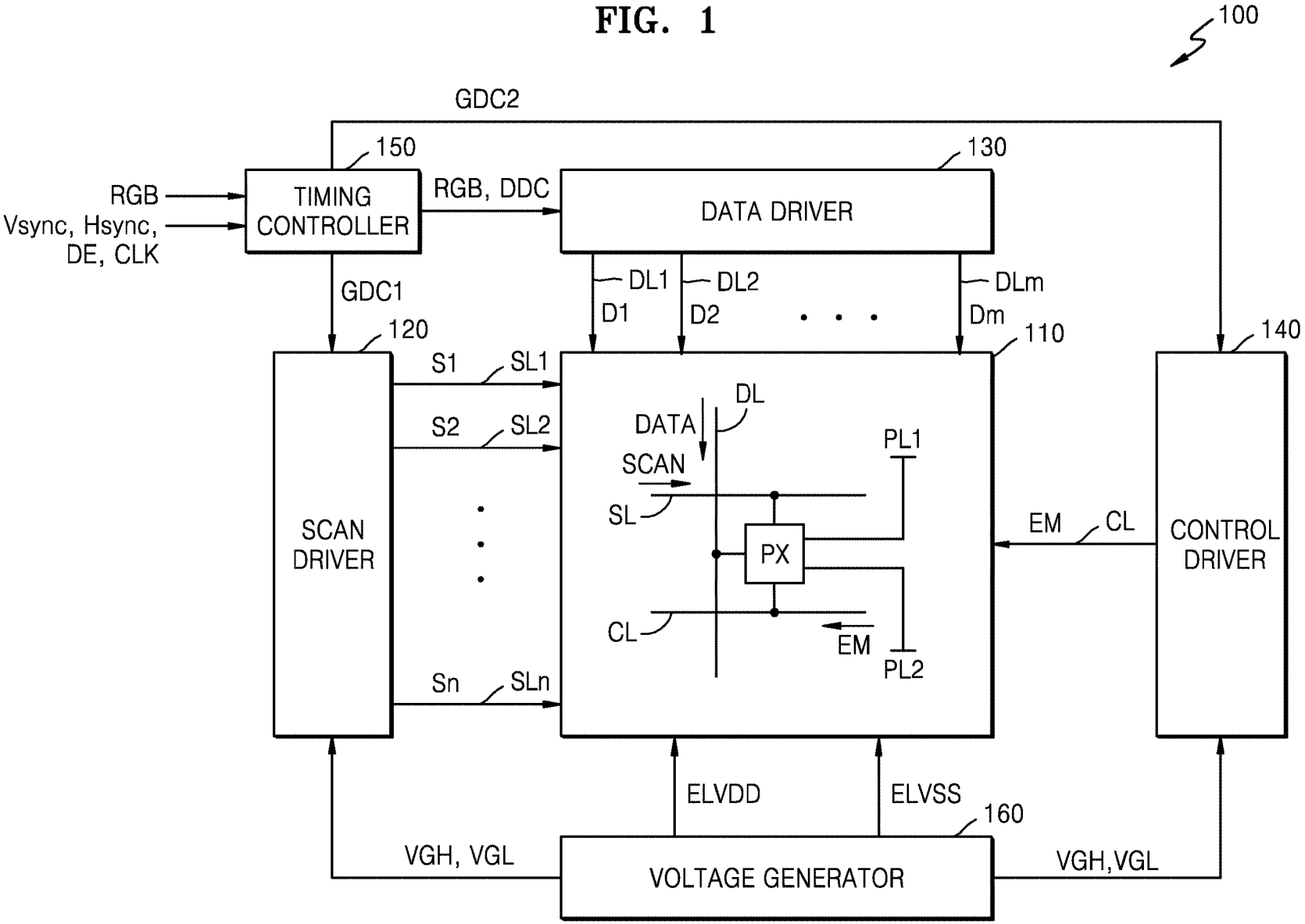
FIG. 1 is a block diagram of a display device according to an embodiment.

As the present disclosure allows for various changes and numerous embodiments, exemplary embodiments will be illustrated in the drawings and described in detail in the written description. Effects and characteristics of present disclosure, and a method of accomplishing them will be apparent by referring to content described below in detail together with the drawings. However, the present disclosure is not limited to exemplary embodiments below and may be implemented in various forms.

Hereinafter, the present disclosure will be described more fully with reference to the accompanying drawings. For clear description of the present disclosure, parts unrelated to descriptions may be omitted, and like reference numerals may be used for like or corresponding elements and repeated descriptions thereof may be omitted when descriptions are made with reference to the drawings.

Sizes of components in the drawings may be exaggerated for convenience of explanation. In other words, since sizes and thicknesses of components shown in the drawings are arbitrarily illustrated for convenience of explanation, the following embodiments are not limited thereto.

It will be understood that when a layer, region, or component is referred to as being "connected" to another layer, region, or component, it may be "directly connected" to the other layer, region, or component or may be "indirectly connected" to the other layer, region, or component with another layer, region, or component being interposed therebetween.

It will be understood that although the terms "first," "second," etc. may be used herein to describe various components, these components should not be limited by these terms. These terms are only used to distinguish one component from another. As used herein, the singular forms "a," "an," and "the" are intended to include the plural forms as well, unless the context clearly indicates otherwise. It will be understood that when a first element includes or has a second element, the first element does not exclude another element and may include another element unless particularly described otherwise.

The terms "corresponding" or "to correspond" in the present specification may mean being arranged or connected in a same row and/or column. For example, it will be understood that when a first member is connected to a "corresponding" second member among a plurality of second members, the first member is connected to a second member arranged in a same row and/or a same column as that of the first member. For example, it will be understood that in the case where a plurality of pixel circuits and a plurality of light-emitting devices such as light-emitting diodes (LEDs) are respectively arranged in a row direction and a column direction over a substrate, when a light-emitting device is connected to a corresponding pixel circuit, the light-emitting device is connected to a pixel circuit that is arranged in a same row and a same column as that of the light-emitting device among the plurality of pixel circuits.

In the accompanying drawings, for example, variations of an illustrated shape may be expected depending on manufacturing technologies and/or tolerance. Therefore, the following embodiments should not be construed as being limited to a specific shape of a region illustrated in the present specification. In other words, the following embodiments include variations and changes in a shape that may be caused or expected during a manufacturing process.

As used herein, the term "and/or" includes any and all combinations of one or more of the associated listed items.

FIG. 1 is a block diagram of a display device 100 according to an embodiment.

Referring to FIG. 1, the display device 100 may include a display unit 110, a scan driver 120, a data driver 130, a control driver 140, a timing controller 150, and a voltage generator 160.

The display unit 110 may include pixels PX arranged in a first direction (e.g., a row direction) and a second direction (e.g., a column direction). For ease of understanding, only one pixel PX is shown in FIG. 1.

The pixels PX may be connected to scan lines SL1 to SLn and data lines DL1 to DLm. The scan lines SL1 to SLn may transmit scan signals S1 to Sn that are output from the scan driver 120 to pixels PX in the same row, respectively, and the data lines DL1 to DLm may transmit data voltages D1 to Dm that are output from the data driver 130 to pixels PX in the same column, respectively. Each of the pixels PX may be connected to a scan line located in the same row among the scan lines SL1 to SLn and may be connected to a data line located in the same column among the data lines DL1 to DLm. Herein, a scan line and a data line that are connected to the pixel PX are referred to as a scan line SL and a data line DL, respectively, and a scan signal and a data voltage that are transmitted to the pixel PX are referred to as a scan signal SCAN and a data voltage DATA, respectively.

The pixels PX may be connected to a control line CL. The control line CL may transmit a control signal EM that is output from the control driver 140 to the pixels PX.

The control line CL may include a plurality of sub control lines, and the sub control lines are connected to the pixels PX that are arranged in the row direction and the column direction. According to an embodiment, the sub control lines may extend in the row direction in parallel with the scan lines SL1 to SLn. The scan lines SL1 to SLn may transmit the scan signals S1 to Sn to the pixels PX at different timings, but all of the sub control lines may transmit a control signal EM to the pixels PX at the same timing. The sub control lines that are all electrically connected to each other may be collectively referred to as a control line CL.

According to another embodiment, the control line CL may include a first control line CL1 for transmitting a first control signal EM1 to the pixels PX and a second control line CL2 for transmitting a second control signal EM2 to the pixels PX.

The pixels PX may be connected to first and second power supply lines PL1 and PL2. The first and second power supply lines PL1 and PL2 may respectively transmit a first driving voltage ELVDD and a second driving voltage ELVSS that are output from the voltage generator 160 to the pixels PX.

The first power supply line PL1 may also include a plurality of first sub power supply lines that are connected to the pixels PX. According to an embodiment, the first sub power supply lines may extend in the column direction in parallel with the data lines DL1 to DLm. The first sub power supply lines that are all electrically connected to each other may be collectively referred to as a first power supply line PL1.

The second power supply line PL2 may also include a plurality of second sub-power supply lines that are connected to the pixels PX. According to an embodiment, the second sub power supply lines may extend in the column direction in parallel with the data lines DL1 to DLm. The second sub power supply lines that are all electrically connected to each other may be collectively referred to as a second power supply line PL2. According to another example, the second power supply line PL2 may be connected to the pixels PX in the form of a common electrode.

The pixel PX may include a light-emitting portion, a pixel circuit, and a light-emitting circuit. The light-emitting portion may include first light-emitting devices connected in a forward direction between a first electrode and a second electrode and second light-emitting devices connected in a reverse direction between the first electrode and the second electrode. The pixel circuit may receive the data voltage DATA in synchronization with the scan signal SCAN and may generate a driving current based on the data voltage DATA and output the driving current to a first node. The light-emitting circuit may be controlled by the control signal EM and may provide a driving current to the first light-emitting devices during a first emission period and a driving current to the second light-emitting devices during a second emission period. Since the first light-emitting devices emit light during the first emission period within one frame period and the second light-emitting devices emit during the second emission period within the same frame period, the brightness of light emitted by the pixel PX may be perceived as being constant regardless of a ratio of the number of second light-emitting devices to the number of first light-emitting devices. The pixel PX may correspond to a part (for example, a sub-pixel) of a pixel that is capable of displaying full color. The pixel PX is described in more detail below with reference to FIG. 2.

The voltage generator 160 may generate voltages required for the operations of the scan driver 120 and the control driver 140. For example, the voltage generator 160 may generate the first driving voltage ELVDD and the second driving voltage ELVSS. The first driving voltage ELVDD is a voltage applied to the pixels PX through the first power supply line PL1, and the second driving voltage ELVSS is a voltage applied to the pixels PX through the second power supply line PL2. The level of the second driving voltage ELVSS may be less than the level of the first driving voltage ELVDD.

The voltage generator 160 may also generate a first gate voltage VGH and a second gate voltage VGL to control a switching transistor of the pixel PX. The level of the first gate voltage VGH may be greater than the level of the second gate voltage VGL.

In the case where the conductivity type of the switching transistor is an n-type, when the first gate voltage VGH is applied to a gate electrode of the switching transistor, the switching transistor is turned on, and when the second gate voltage VGL is applied to the gate electrode of the switching transistor, the switching transistor is turned off. In this case, the first gate voltage VGH may be referred to as a turn-on voltage, and the second gate voltage VGL may be referred to as a turn-off voltage. On the contrary, in the case where the conductivity type of the switching transistor is a p-type, when the first gate voltage VGH is applied to the gate electrode of the switching transistor, the switching transistor is turned off, and when the second gate voltage VGL is applied to the gate electrode of the switching transistor, the switching transistor is turned on. In this case, the first gate voltage VGH may be referred to as a turn-off voltage, and the second gate voltage VGL may be referred to as a turn-on voltage.

The voltage generator 160 may generate voltages at other levels in addition to the four voltages, i.e., ELVDD, ELVSS, VGH, and VGL, and provide the generated voltages to the control driver 140. For example, the voltage generator 160 may generate gamma reference voltages and provide the gamma reference voltages to the data driver 130.

The timing controller 150 may control the display unit 110 by controlling operation timings of the scan driver 120, the data driver 130, and the control driver 140. The pixels PX of the display unit 110 may receive a new data voltage DATA every frame period and emit light at a luminance corresponding to the received data voltage DATA to thereby display an image corresponding to image data RGB (herein also referred to as digital data signal) of one frame. According to an embodiment, one frame period is a period in which an image of one frame is displayed through the pixels PX of the display unit 110. Each of the pixels PX may receive the data voltage DATA in synchronization with the scan signal SCAN every frame and emit light of a luminance corresponding to the data voltage DATA for one frame period.

The timing controller 150 may receive a vertical synchronization signal Vsync, a horizontal synchronization signal Hsync, a data enable signal DE, a clock signal CLK, and image data RGB from the outside. The timing controller 150 may control the operation timings of the scan driver 120, the data driver 130, and the control driver 140 by using timing signals such as the vertical synchronization signal Vsync, the horizontal synchronization signal Hsync, the data enable signal DE, and the clock signal CLK. The timing controller 150 may determine a frame period by counting the data enable signal DE of one horizontal scanning period, and in this case, the vertical synchronization signal Vsync and the horizontal synchronization signal Hsync supplied from the outside may be omitted. The image data RGB may include luminance information of the pixels PX. The luminance may have a predetermined number of bits representing gray levels, for example, 1024 ($2^{10}$), 256 ($2^8$), or 64 ($2^6$) gray levels.

The timing controller 150 may generate control signals including a first gate timing control signal GDC1 for controlling the operation timing of the scan driver 120, a data timing control signal DDC for controlling the operation timing of the data driver 130, and a second gate timing control signal GDC2 for controlling the operation timing of the control driver 140.

The first gate timing control signal GDC1 may include, but is not limited to, a gate start pulse (GSP), a gate shift clock (GSC), a gate output enable (GOE) signal, and the like. The GSP is supplied to the scan driver 120 for generating a first scan signal at a start time of a scan period. The GSC is a clock signal input to the scan driver 120, and is a clock signal for shifting the GSP. The GOE signal controls an output of the scan driver 120. The second gate timing control signal GDC2 is provided to the control driver 140.

The data timing control signal DDC may include, but is not limited to, a source start pulse (SSP), a source sampling clock (SSC), a source output enable (SOE) signal, and the like. The SSP controls a data sampling start time of the data driver 130 and is provided to the data driver 130 at a start time of a scan period. The SSC is a clock signal for controlling the sampling operation of data in the data driver 130 on the basis of a rising or falling edge. The SOE signal may control an output of the data driver 130. The SSP supplied to the data driver 130 may be omitted depending on a data transmission scheme.

The scan driver 120 may sequentially generate the scan signals S1 to Sn in response to the first gate timing control signal GDC1 supplied from the timing controller 150 by using the first and second gate voltages VGH and VGL provided from the voltage generator 160. The scan driver 120 may provide the scan signals S1 to Sn to the pixels PX of the display unit 110 through the scan lines SL1 to SLn.

The data driver 130 may sample and latch the digital data signal RGB supplied from the timing controller 150 in response to the data timing control signal DDC supplied from the timing controller 150 to convert the digital data signal RGB into a parallel data. When the data driver 130 converts the digital data signal RGB into the parallel data, the data driver 130 may convert the digital data signal RGB into a gamma reference voltage and convert the gamma reference voltage into an analog data voltage. The data driver 130 may provide the data voltages D1 to Dm to the pixels PX of the display unit 110 through the data lines DL1 to DLm. The pixel PX may receive the data voltage DATA in response to the scan signal SCAN.

The control driver 140 may drive the control line CL in response to the second gate timing control signal GDC2 supplied from the timing controller 150 by using the first and second gate voltages VGH and VGL provided from the voltage generator 160. The control driver 140 may alternately output the first gate voltage VGH and the second gate voltage VGL to the control line CL in response to the second gate timing control signal GDC2. The first gate voltage VGH and the second gate voltage VGL that are transmitted through the control line CL may be a control signal EM that has a first logic level and a control signal EM that has a second logic level, respectively. The control driver 140 may alternately output the first gate voltage VGH and the second gate voltage VGL to the control line CL multiple times during one frame period. For example, the control driver 140 may sequentially output four gate voltages in the sequence of the first gate voltage VGH, the second gate voltage VGL, the first gate voltage VGH, and the second gate voltage VGL to the control line CL for one frame period. According to another example, the control driver 140 may sequentially output eight gate voltages in the sequence of the first gate voltage VGH, the second gate voltage VGL, the first gate voltage VGH, the second gate voltage VGL, the first gate voltage VGH, the second gate voltage VGL, the first gate voltage VGH, and the second gate voltage VGL to the control line CL for one frame period.

Figure 2:
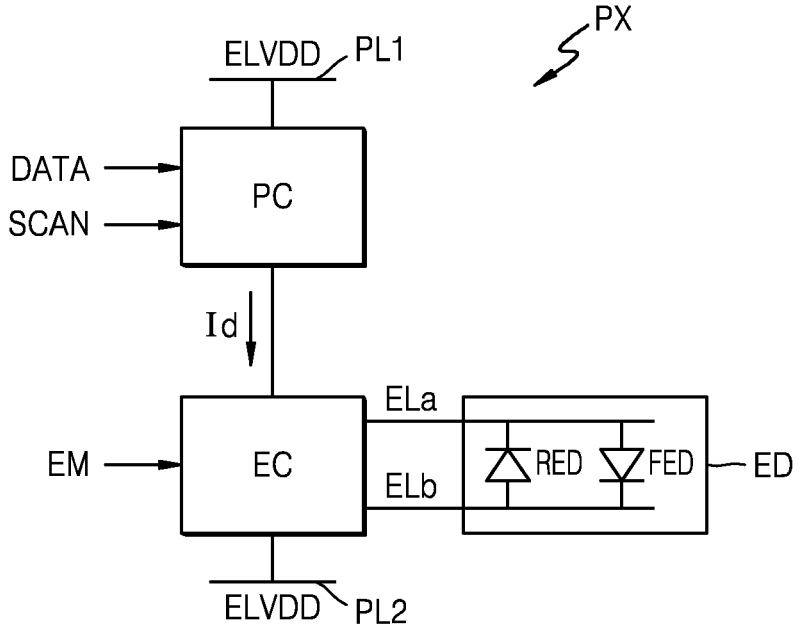
FIG. 2 is a block diagram of a pixel according to an embodiment.

FIG. 2 is a block diagram of a pixel PX according to an embodiment.

Referring to FIG. 2, the pixel PX may include a pixel circuit PC, a light-emitting circuit EC, and a light-emitting portion ED. The pixel PX may be connected to first and second power supply lines PL1 and PL2 and receive first and second driving voltages ELVDD and ELVSS. Furthermore, the pixel PX may receive a scan signal SCAN, a data voltage DATA, and a control signal EM.

The light-emitting portion ED may include first light-emitting devices that are connected in a forward direction between a first electrode ELa and a second electrode ELb and second light-emitting devices that are connected in a reverse direction between the first electrode ELa and the second electrode ELb. In FIG. 2, the first light-emitting devices that are connected in the forward direction between the first electrode ELa and the second electrode ELb are collectively referred to as a first light-emitting device FED and the second light-emitting devices that are connected in the reverse direction between the first electrode ELa and the second electrode ELb are collectively referred to as a second light-emitting device RED.

The pixel circuit PC may be connected between the first power supply line PL1 and a first node N and may receive the scan signal SCAN and the data voltage DATA. The pixel circuit PC may receive the data voltage DATA in synchronization with the scan signal SCAN and may generate a driving current Id based on the data voltage DATA and output the driving current Id to the first node N. The magnitude of the driving current Id may be determined according to a voltage level of the data voltage DATA.

The light-emitting circuit EC may be connected between the first node N and the second power supply line PL2 and may receive the control signal EM. The light-emitting circuit EC may be connected to the light-emitting portion ED through the first electrode ELa and the second electrode ELb. The light-emitting circuit EC may be controlled by the control signal EM. The light-emitting circuit EC may provide the driving current Id to the first light-emitting device FED during a first emission period and provide the driving current Id to the second light-emitting device RED during a second emission period. The time length of the first emission period and the time length of the second emission period may be equal to each other. One frame period may be an even multiple of four times or more times of a time length of the first emission period or a time length of the second emission period. In this case, a flicker phenomenon may not occur in the display unit 110 or may not be recognized by a viewer because the time length of the first emission period and the time length of the second emission period are shorter than ½ of one frame period.

Figure 3:
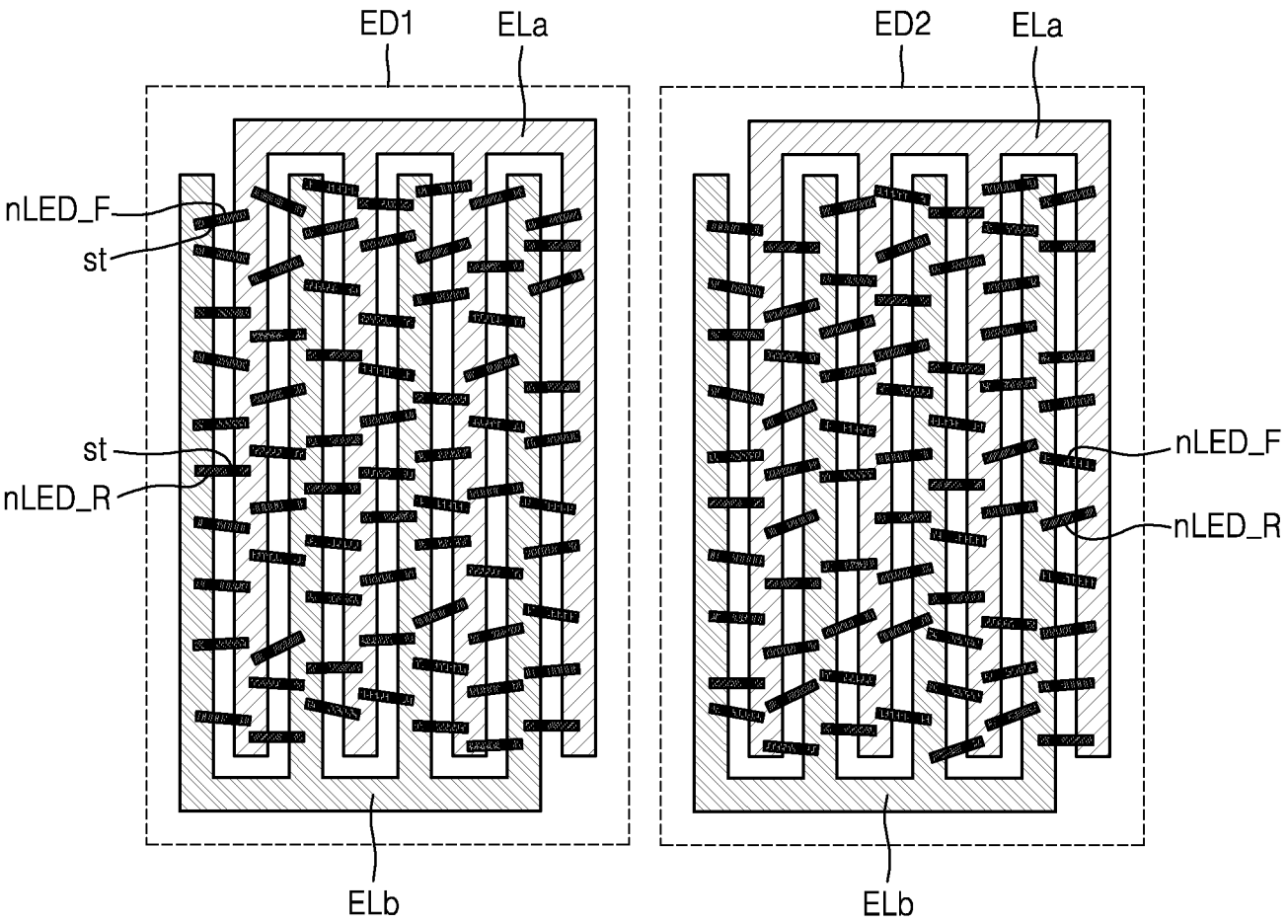
FIG. 3 is a schematic plan view of a light-emitting portion according to an embodiment.

FIG. 3 is a schematic plan view of a light-emitting portion ED according to an embodiment.

Referring to FIG. 3, the light-emitting portion ED may include light-emitting devices that are connected in a forward direction between a first electrode ELa and a second electrode ELb and light-emitting devices that are connected in a reverse direction between the first electrode ELa and the second electrode ELb.

The light-emitting devices that are connected in the forward direction between the first electrode ELa and the second electrode ELb are referred to as first light-emitting devices nLED_F, and the light-emitting devices that are connected in the reverse direction between the first electrode ELa and the second electrode ELb are referred to as second light-emitting devices nLED_R. However, the first light-emitting devices nLED_F and the second light-emitting devices nLED_R may have substantially the same structure and characteristics and may be collectively referred to as light-emitting devices nLED. Each of the light-emitting devices nLED may be a micro light-emitting diode (LED) that may have an anode and a cathode and may emit light when a voltage exceeding a threshold voltage is applied between the anode and the cathode. In FIG. 3, a line st indicating a cathode is shown in each of the light-emitting devices nLED.

In the first light-emitting devices nLED_F that are connected in the forward direction between the first electrode ELa and the second electrode ELb, a cathode indicated with a line st is connected to the second electrode ELb, and an anode is connected to the first electrode ELa. In the second light-emitting devices nLED_R that are connected in the reverse direction between the first electrode ELa and the second electrode ELb, a cathode indicated with a line st is connected to the first electrode Ela, and an anode is connected to the second electrode ELb.

FIG. 3 illustrates a first light-emitting portion ED1 and a second light-emitting portion ED2 that are different from each other. The first light-emitting portion ED1 and the second light-emitting portion ED2 may constitute different pixels PX in the same display device 100. For example, a pixel PX including the first light-emitting portion ED1 and a pixel PX including the second light-emitting portion ED2 may be arranged adjacent to each other.

The ratio of the first light-emitting devices nLED_F to all the light-emitting devices nLED may differ between the first light-emitting portion ED1 and the second light-emitting portion ED2. For example, in the first light-emitting portion ED1, the ratio of the first light-emitting devices nLED_F to all the light-emitting devices nLED is about 80%, and in the second light-emitting portion ED2, the ratio of the first light-emitting devices nLED_F to all the light-emitting devices nLED is about 70%. However, it is understood that these ratios of the first light-emitting devices nLED_F to all the light-emitting devices nLED are only examples, and each pixel PX included in the display device 100 may have different ratios without deviating from the scope of the present disclosure. Even if the ratios vary for the pixels PX in the display device 100, the luminance of the display device 100 can be maintained to be uniform because the light-emitting devices in each pixel PX emit light either in the first emission period or the second emission period during one frame period irrespective of their polarity.

The light-emitting portion ED may be formed by applying a voltage between a first electrode ELa and a second electrode ELb, each of which formed on a substrate, to thereby form an electric field. Then, a mixed liquid containing the light-emitting devices nLED is dropped onto the first electrode ELa and the second electrode ELb, and the light-emitting devices nLED are aligned on the first electrode ELa and the second electrode ELb by the electric field. Some of the light-emitting devices nLED may be connected in the forward direction between the first electrode ELa and the second electrode ELb, and other light-emitting devices nLED may be connected in the reverse direction between the first electrode ELa and the second electrode ELb, as shown in FIG. 3. When the light-emitting portion ED is formed in this manner, the number of light-emitting devices nLED included in each of the pixels PX may not be precisely controlled. In addition, in each of the pixels PX, the ratio of the number of second light-emitting devices nLED_R to the number of first light-emitting devices nLED_F may not be constant. That is, the ratio of the second light-emitting devices nLED_R connected in the reverse direction to all the light-emitting devices nLED may be different for each pixel PX.

When the pixel PX is designed such that a driving current flows only from the first electrode ELa to the second electrode ELb, the second light-emitting devices nLED_R may not emit light. The pixels PX that are designed to emit light at the same luminance at the same gray level may emit light with different luminance if the ratio of the first light-emitting devices nLED_F to all the light-emitting devices nLED varies.

The first electrode ELa and the second electrode ELb may be spaced apart at regular intervals. FIG. 3 illustrates a structure in which the first electrode ELa and the second electrode ELb are alternately arranged, portions (e.g., branches or protrusions) of the first electrode ELa are connected to each other at the top thereof, and portions (e.g., branches or protrusions) of the second electrode ELb are connected to each other at the bottom thereof, but the structure shown in FIG. 3 is only an example. The first electrode ELa and the second electrode ELb may be arranged in parallel to each other or may be arranged in a spiral shape at regular intervals. The arrangement of the first electrode ELa and the second electrode ELb does not limit the scope of the present disclosure.

FIGS. 4A to 4D are views of light-emitting devices nLED according to various embodiments.

Figure 4A:
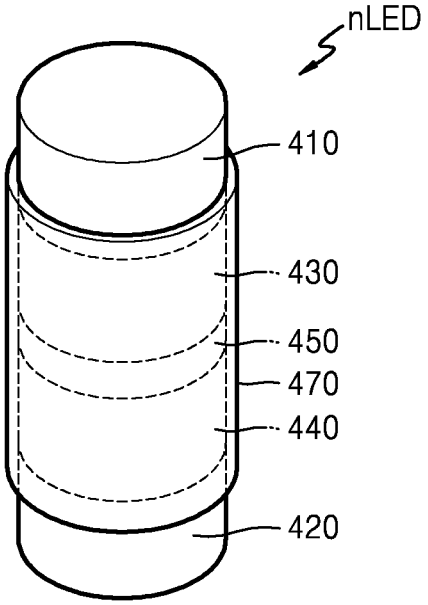
FIGS. 4A to 4D are views of light-emitting devices according to various embodiments.

Referring to FIG. 4A, the light-emitting device nLED according to an embodiment may include a first electrode layer 410, a second electrode layer 420, a first semiconductor layer 430, a second semiconductor layer 440, and an active layer 450 located between the first semiconductor layer 430 and the second semiconductor layer 440. According to an embodiment, the first electrode layer 410, the first semiconductor layer 430, the active layer 450, the second semiconductor layer 440, and the second electrode layer 420 may be sequentially stacked in a lengthwise direction of the light-emitting device nLED. The length of the light-emitting device nLED may be about 1 μm to about 10 μm, and the diameter of the light-emitting device nLED may be about 0.5 μm to about 500 μm; however, it is noted that the present disclosure is not limited to this exemplary embodiment, and the length, the diameter, and shape of the light-emitting device nLED may vary without deviating from the scope of the present disclosure.

The first electrode layer 410 and the second electrode layer 420 may be ohmic contact electrodes. However, the first electrode layer 410 and the second electrode layer 420 are not limited thereto and may be other types of contact electrodes such as Schottky contact electrodes. The first electrode layer 410 and the second electrode layer 420 may include one or more metals such as aluminum, titanium, indium, gold, and silver. Materials included in the first electrode layer 410 and the second electrode layer 420 may be the same or different from each other.

The first semiconductor layer 430 may include, for example, an n-type semiconductor layer, and the second semiconductor layer 440 may include, for example, a p-type semiconductor layer. The first semiconductor layer 430 may include, but is not limited to, a semiconductor material such as GaN, AlN, AlGaN, InGaN, InN, InAlGaN, and AlInN. The first semiconductor layer 430 may be doped with an n-type dopant such as Si, Ge, and Sn. The second semiconductor layer 440 may be doped with a p-type dopant such as Mg, Zn, Ca, Sr, and Ba. However, the present disclosure is not limited thereto, and the first semiconductor layer 430 may include a p-type semiconductor layer and the second semiconductor layer 440 may include an n-type semiconductor layer.

The active layer 450 may be arranged between the first semiconductor layer 430 and the second semiconductor layer 440, and may have, for example, a single or multiple quantum-well structure. The active layer 450 corresponds to a region in which an electron and a hole recombine. As an electron and a hole recombine, the active layer 450 may transition to a lower energy level and generate light having a wavelength corresponding thereto. The active layer 450 may be located variously depending on the type of the light-emitting device nLED. It is noted that the light-emitting device nLED is not limited to the embodiments described above. For example, the light-emitting device nLED may further include a separate fluorescent body layer, an active layer, a semiconductor layer, and/or an electrode layer above and below the first semiconductor layer 430 and the second semiconductor layer 440. Light generated from the active layer 450 may be emitted to an outer surface and/or both lateral surfaces of the light-emitting device nLED.

The light-emitting device nLED may further include an insulating layer 470 that covers an outer surface thereof. In an embodiment, the insulating layer 470 may cover the active layer 450 and prevent the active layer 450 from contacting the first electrode ELa or the second electrode ELb. The insulating layer 470 may also prevent reduction of emission efficiency by protecting an outer surface of the light-emitting device nLED including an outer surface of the active layer 450.

Figure 4B:
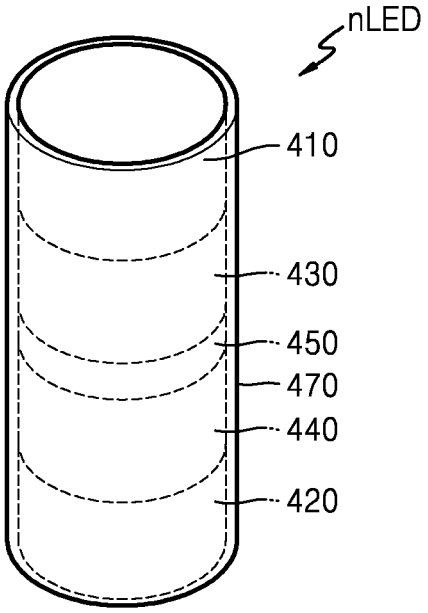

FIG. 4B illustrates the light-emitting device nLED that is different from the light-emitting device nLED illustrated in FIG. 4A in that the insulating layer 470 covers an entire outer surface of the light-emitting device nLED, but other configurations are substantially the same as those of FIG. 4A.

Figure 4C:
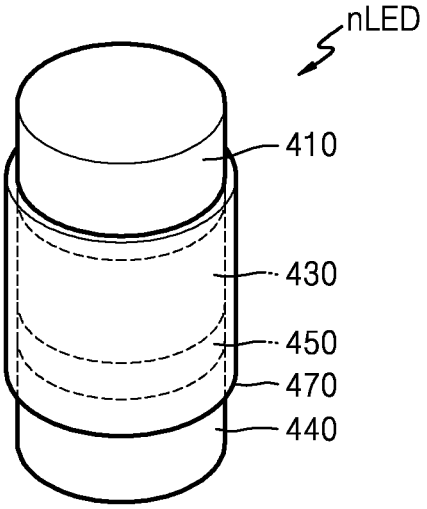

FIG. 4C illustrates the light-emitting device nLED in which the second electrode layer 420 is omitted compared to the light-emitting device nLED of FIG. 4A. However, this is only an example, and any one of the first electrode layer 410 and the second electrode layer 420, i.e., the second electrode layer 420, may be omitted in the light-emitting device nLED of FIG. 4A.

In the light-emitting device nLED of FIG. 4C, the insulating layer 470 covers a portion of an outer surface of the first electrode layer 410 and a portion of an outer surface of the second semiconductor layer 440. According to another embodiment, the insulating layer 470 may cover an entire outer surface of the second semiconductor layer 440.

Figure 4D:
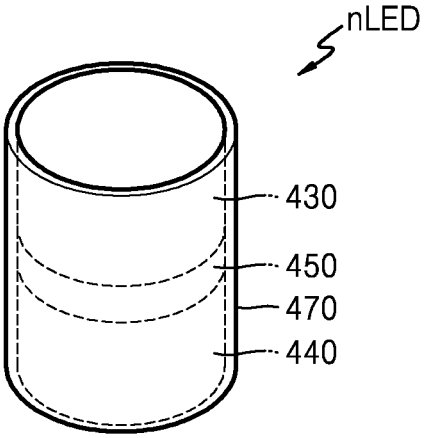

FIG. 4D illustrates a light-emitting device nLED in which both the first electrode layer 410 and the second electrode layer 420 are omitted compared to the light-emitting device nLED of FIG. 4A. As illustrated in FIG. 4D, the insulating layer 470 covers entire outer surfaces of the first semiconductor layer 430, the active layer 450, and the second semiconductor layer 440, but the present disclosure is not limited thereto. The insulating layer 470 may cover at least a portion of outer surfaces of the first semiconductor layer 430 and the second semiconductor layer 440 and expose a portion of the outer surfaces thereof.

Figure 5A:
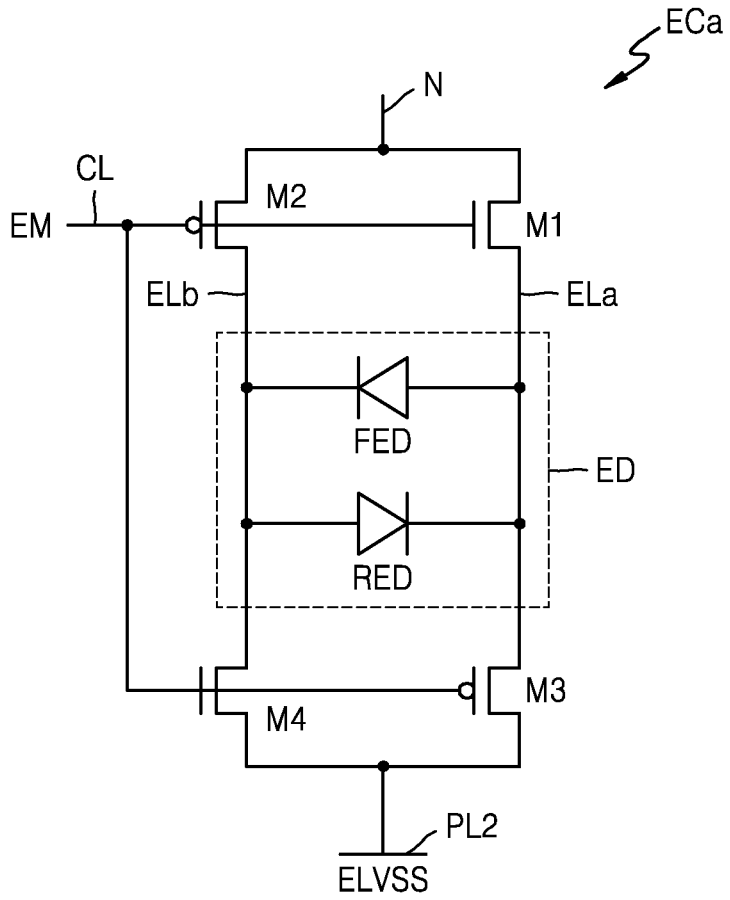
FIG. 5A is a circuit diagram of a light-emitting circuit according to an embodiment.
Figure 5B:
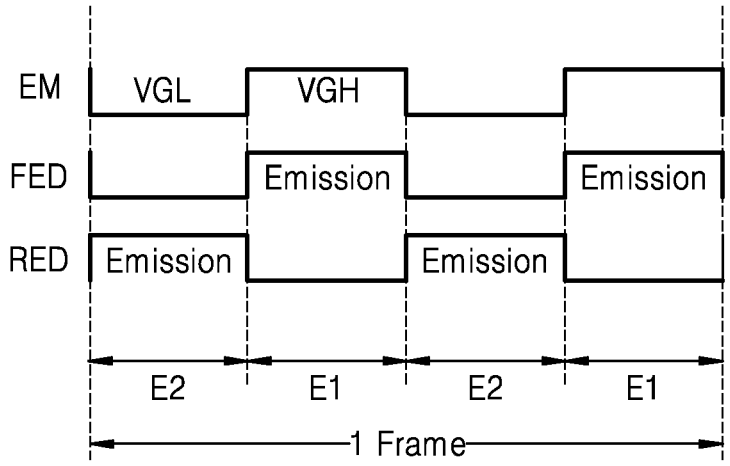
FIG. 5B is a drive timing diagram of the light-emitting circuit of FIG. 5A.

FIG. 5A is a circuit diagram of a light-emitting circuit ECa according to an embodiment, and FIG. 5B is a drive timing diagram of the light-emitting circuit ECa of FIG. 5A.

Referring to FIG. 5A, the light-emitting circuit ECa may be connected between a node N and a second power supply line PL2 and may be further connected to a control line CL to receive a control signal EM. In addition, the light-emitting circuit ECa may be connected to a light-emitting portion ED through a first electrode ELa and a second electrode ELb. As described above, the light-emitting portion ED may include one or more first light-emitting devices nLED_F that are connected in a forward direction between the first electrode ELa and the second electrode ELb and one or more second light-emitting devices nLED_R that are connected in a reverse direction between the first electrode ELa and the second electrode ELb. In FIG. 5A, the first light-emitting devices nLED_F are collectively represented as a first light-emitting device FED and the second light-emitting devices nLED_R are collectively represented as a second light-emitting device RED.

The light-emitting circuit ECa may include a first transistor M1 that is connected between the node N and the first electrode ELa, a second transistor M2 that is connected between the node N and the second electrode ELb, a third transistor M3 that is connected between the first electrode ELa and the second power supply line PL2, and a fourth transistor M4 that is connected between the second electrode ELb and the second power supply line PL2. All the gate electrodes of the first to fourth transistors M1 to M4 may be connected to the control line CL, and thus the first to fourth transistors M1 to M4 may all be controlled by the control signal EM.

The conductivity types of the first and fourth transistors M1 and M4 may be opposite to the conductivity types of the second and third transistors M2 and M3. According to an embodiment, as shown in FIG. 5A, the conductivity types of the first and fourth transistors M1 and M4 may be an n-type, and the conductivity types of the second and third transistors M2 and M3 may be a p-type. According to another example, the conductivity types of the first and fourth transistors M1 and M4 may be a p-type, and the conductivity types of the second and third transistors M2 and M3 may be an n-type.

Referring to FIG. 5B, a first emission period E1 may be a period during which the first light-emitting device FED emits light, and a second emission period E2 may be a period during which the second light-emitting device RED emits light. In the case of the light-emitting circuit ECa illustrated in FIG. 5A, the control signal EM may have a high level VGH during the first emission period E1 and have a low level VGL during the second emission period E2. According to another example, when the conductivity types of the first to fourth transistors M1 to M4 are opposite to those shown in FIG. 5A, the control signal EM may have the low level VGL during the first emission period E1 and have the high level VGH during the second emission period E2.

During the first emission period E1, the first and fourth transistors M1 and M4 are turned on by the control signal EM that has the high level VGH, and the second and third transistors M2 and M3 are turned off by the control signal EM that has the high level VGH. In this case, a driving current (i.e., the driving current Id in FIG. 2) that is output by the pixel circuit PC of FIG. 2 through the node N flows through the first light-emitting device FED. During the second emission period E2, the second and third transistors M2 and M3 are turned on by the control signal EM that has the low level VGL, and the first and fourth transistors M1 and M4 are turned off by the control signal EM that has the low level VGL. In this case, the driving current output by the pixel circuit PC of FIG. 2 through the node N flows through the second light-emitting device RED.

During the first emission period E1, the control driver 140 of FIG. 1 may output the control signal EM that has a first logic level (i.e., the high level VGH) to the control line CL to turn on the first and fourth transistors M1 and M4 and turn off the second and third transistors M2 and M3, such that the driving current (i.e., the driving current Id in FIG. 2) flows through the first light-emitting device FED. During the second emission period E2, the control driver 140 of FIG. 1 may output the control signal EM that has a second logic level (i.e., the low level VGL) to the control line CL to turn on the second and third transistors M2 and M3 and turn off the first and fourth transistors M1 and M4, such that the driving current (i.e., the driving current Id in FIG. 2) flows through the second light-emitting device RED.

A plurality of first emission periods E1 and a plurality of second emission periods E2 may be alternately present in one frame period that is represented by '1 Frame'. In the timing diagram of FIG. 5B, two first emission periods E1 and two second emission periods E2 may be alternately present in one frame period '1 Frame'. However, this case is merely an example, and three or more first emission periods E1 and three or more second emission periods E2 may be alternately present in one frame period '1 Frame' without deviating from the scope of the present disclosure. To this end, the control driver 140 of FIG. 1 may alternately output multiple times a control signal EM that has a first logic level (e.g., the high level VGH) and a control signal EM that has a second logic level (e.g., the low level VGL) for one frame period '1 Frame'. In this case, the flicker phenomenon may be reduced in the display unit 110 in FIG. 1.

According to one embodiment, the time length of the first emission period E1 and the time length of the second emission period E2 may be the same. The time length of the first emission period E1 and the time length of the second emission period E2 may be (½)k (where k is a natural number of 2 or more) of one frame period '1 Frame'. However, it is noted that the time length of the first emission period E1 and the time length of the second emission period E2 may be varied depending on various parameters, for example, the ratio of the number of second light-emitting devices to the number of first light-emitting devices, or vice versa.

Figure 6A:
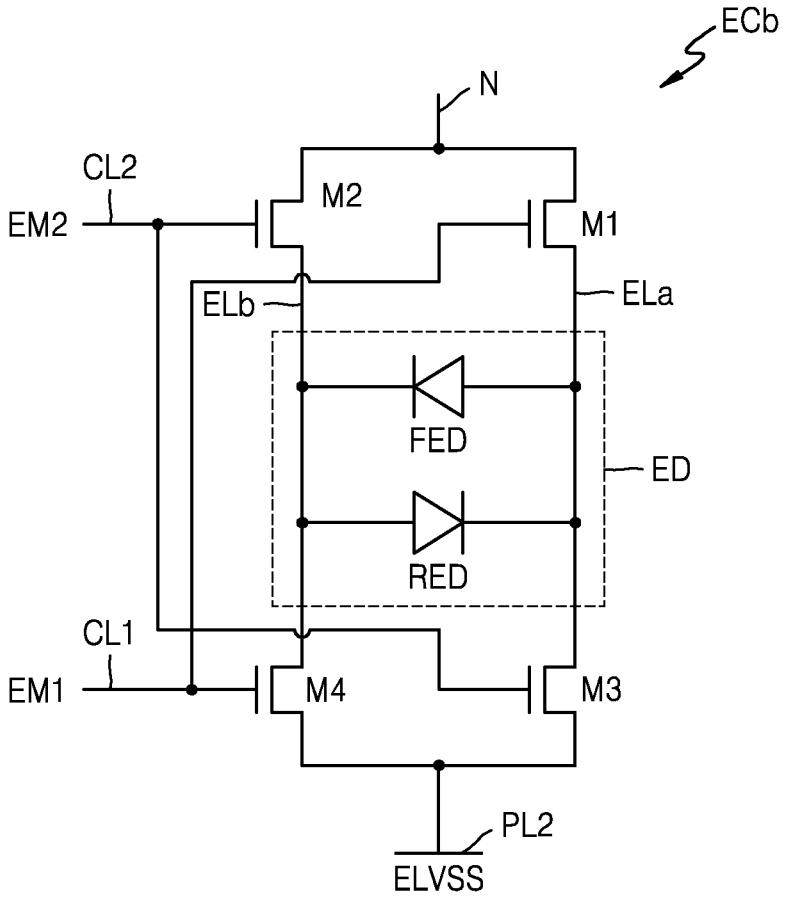
FIG. 6A is a circuit diagram of a light-emitting circuit according to another embodiment.
Figure 6B:
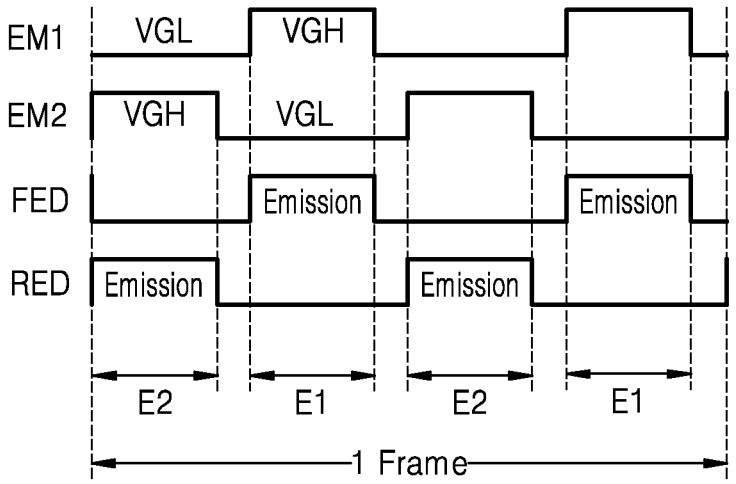
FIG. 6B is a drive timing diagram of the light-emitting circuit of FIG. 6A.

FIG. 6A is a circuit diagram of a light-emitting circuit ECb according to another embodiment, and FIG. 6B is a drive timing diagram of the light-emitting circuit ECb of FIG. 6A.

Referring to FIG. 6A, the light-emitting circuit ECb according to another embodiment may be connected between a node N and a second power supply line PL2 and may be further connected to a light-emitting portion ED through a first electrode ELa and a second electrode ELb. In addition, the light-emitting circuit ECb may be connected to a first control line CL1 to receive a first control signal EM1 and may be connected to a second control line CL2 to receive a second control signal EM2.

The light-emitting circuit ECb may include a first transistor M1 that is connected between the node N and the first electrode ELa, a second transistor M2 that is connected between the node N and the second electrode ELb, a third transistor M3 that is connected between the first electrode ELa and the second power supply line PL2, and a fourth transistor M4 that is connected between the second electrode ELb and the second power supply line PL2. The conductivity types of the first and fourth transistors M1 and M4 may be the same. In FIG. 6, the conductivity types of the first and fourth transistors M1 and M4 are an n-type. However, this case is merely an example, and the conductivity types of the first and fourth transistors M1 and M4 may be an p-type.

The gate electrodes of the first and fourth transistors M1 and M4 may be connected to the first control line CL1 in common, and the first and fourth transistors M1 and M4 may be controlled by the first control signal EM1. The gate electrodes of the second and third transistors M2 and M3 may be connected to the second control line CL2 in common, and the second and third transistors M2 and M3 may be controlled by the second control signal EM2.

Referring to FIG. 6B, a first emission period E1 may be a period during which a first light-emitting device FED in FIG. 6A emits light, and a second emission period E2 may be a period during which a second light-emitting device RED in FIG. 6A emits light. In the case of the light-emitting circuit ECb shown in FIG. 6A, the first control signal EM1 may have a high level VGH during the first emission period E1 and have a low level VGL during the remaining period. The second control signal EM2 may have a high level VGH during the second emission period E2 and have a low level VGL during the remaining period.

During the first emission period E1, the first and fourth transistors M1 and M4 are turned on by the first control signal EM1 that has the high level VGH, and the second and third transistors M2 and M3 are turned off by the second control signal EM2 that has the low level VGL. In this case, a driving current (i.e., the driving current Id in FIG. 2) that is output by the pixel circuit PC of FIG. 2 through the node N flows through the first light-emitting device FED. During the second emission period E2, the first and fourth transistors M1 and M4 are turned off by the first control signal EM1 that has the low level VGL, and the second and third transistors M2 and M3 are turned on by the second control signal EM2 that has the high level VGH. In this case, the driving current (i.e., the driving current Id in FIG. 2) that is output by the pixel circuit PC through the node N flows through the second light-emitting device RED.

During the first emission period E1, the control driver 140 of FIG. 1 may output the first control signal EM1 that has a turn-on level (e.g., the high level VGH) to the first control line CL1 to turn on the first and fourth transistors M1 and M4 and output the second control signal EM2 that has a turn-off level (e.g., the low level VGL) to the second control line CL2 to turn off the second and third transistors M2 and M3, such that the driving current (i.e., the driving current Id in FIG. 2) flows through the first light-emitting device FED. During the second emission period E2, the control driver 140 of FIG. 1 may output the first control signal EM1 that has a turn-off level (e.g., the low level VGL) to the first control line CL1 to turn off the first and fourth transistors M1 and M4 and output the second control signal EM2 that has a turn-on level (e.g., the high level VGH) to the second control line CL2 to turn on the second and third transistors M2 and M3, such that the driving current (i.e., the driving current Id in FIG. 2) flows through the second light-emitting device RED.

The first control line CL1 may be connected to all the pixels PX in the display unit 110. The second control line CL2 may also be connected to all the pixels PX in the display unit 110.

The control driver 140 of FIG. 1 may control a first duty ratio that is a ratio of a turn-on level of the first control signal EM1, and a second duty ratio that is a ratio of a turn-on level of the second control signal EM2, under the control of the timing controller 150 of FIG. 1. The first duty ratio of the first control signal EM1 and the second duty ratio of the second control signal EM2 may be equal to each other. The first duty ratio and the second duty ratio may be 50% or less. As the first duty ratio and the second duty ratio decrease, the overall brightness of the pixels PX of the display unit 110 decreases. The timing controller 150 may control the first duty ratio of the first control signal EM1 and the second duty ratio of the second control signal EM2 through the control driver 140 to adjust the overall brightness of the display unit 110.

Figure 7A:
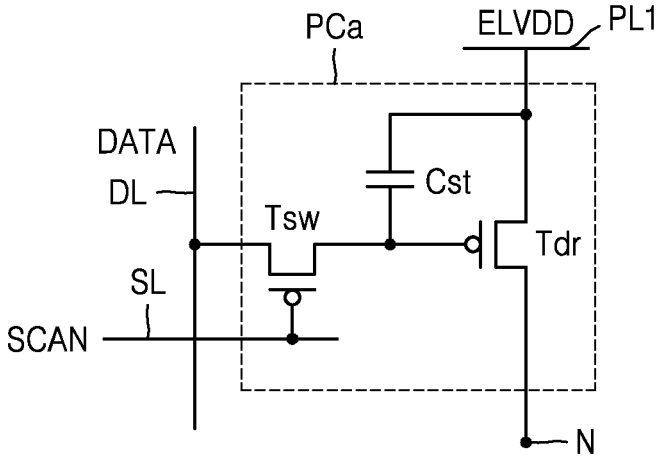
FIG. 7A is a circuit diagram of a pixel circuit according to an embodiment.

FIG. 7A is a circuit diagram of a pixel circuit PCa according to an embodiment.

Referring to FIG. 7A, the pixel circuit PCa may be connected between a first power supply line PL1 and a node N and may be further connected to a data line DL and a scan line SL to receive a data voltage DATA and a signal SCAN. The pixel circuit PCa may receive the data voltage DATA in synchronization with the scanning signal SCAN and may generate a driving current Id from a first driving voltage ELVDD that is supplied from the first power supply line PL1 based on the data voltage DATA and output the driving current Id to the node N.

As shown in FIG. 7A, the pixel circuit PCa may include a driving transistor Tdr that is connected between the first power supply line PL1 and the node N and generates the driving current Id according to the data voltage DATA. The pixel circuit PCa may include a switching transistor Tsw that is connected between the data line DL and the gate electrode of the driving transistor Tdr and controlled by the scan signal SCAN. The pixel circuit PCa may include a storage capacitor Cst that is connected to the gate electrode of the driving transistor Tdr and stores the data voltage DATA for one frame period. The storage capacitor Cst may be connected between the gate electrode of the driving transistor Tdr and the first power supply line PL1.

As shown in FIG. 7A, the driving transistor Tdr and the switching transistor Tsw may be p-type MOSFETs.

Figure 7B:
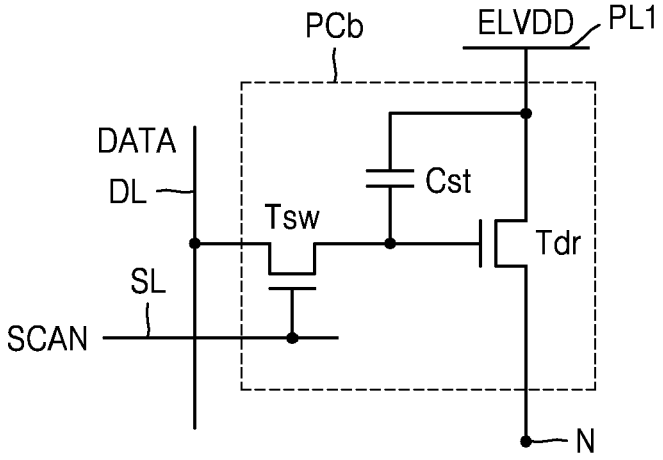
FIG. 7B is a circuit diagram of a pixel circuit according to another embodiment.

FIG. 7B is a circuit diagram of a pixel circuit PCb according to another embodiment.

The pixel circuit PCb shown in FIG. 7B may be substantially the same as the pixel circuit PCa shown in FIG. 7A except for the conductivity types of the driving transistor Tdr and the switching transistor Tsw. As shown in FIG. 7B, the driving transistor Tdr and the switching transistor Tsw of the pixel circuit PCb may be n-type MOSFETs.

Figure 7C:
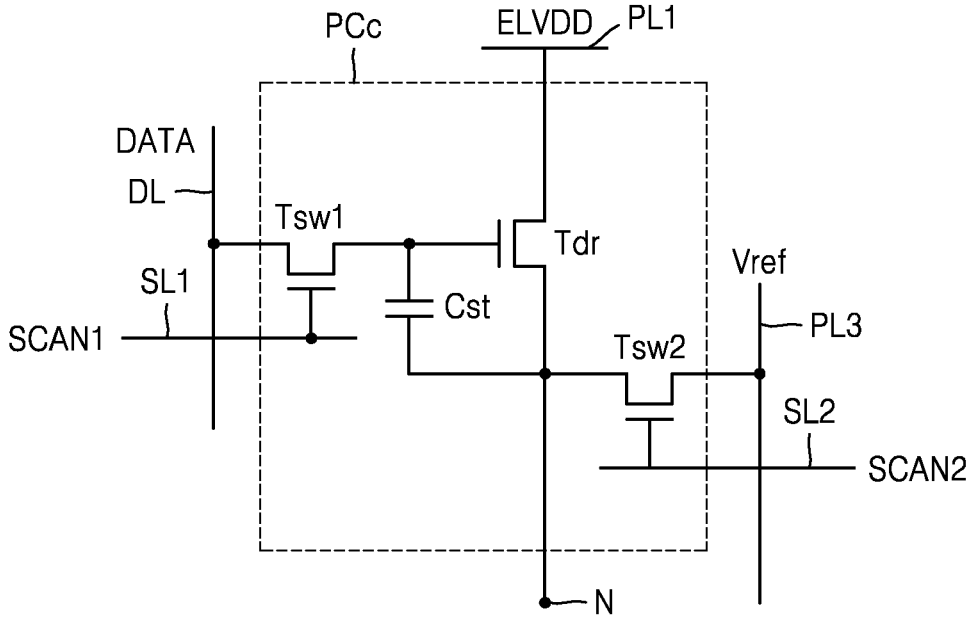
FIG. 7C is a circuit diagram of a pixel circuit according to still another embodiment.

FIG. 7C is a circuit diagram of a pixel circuit PCc according to still another embodiment.

Referring to FIG. 7C, the pixel circuit PCc may be connected between a first power supply line PL1 and a node N and may be further connected to a data line DL to receive a data voltage DATA. The pixel circuit PCc may receive a first scan signal SCAN1 through a first scan line SL1 and receive a second scan signal SCAN2 through a second scan line SL2. The pixel circuit PCc may be connected to a third power supply line PL3 for carrying a reference voltage Vref. The pixel circuit PCc may receive the data voltage DATA in synchronization with the first scanning signal SCAN1 and may generate a driving current Id from a first driving voltage ELVDD that is supplied from the first power supply line PL1 based on the data voltage DATA and output the driving current Id to the node N.

As shown in FIG. 7C, the pixel circuit PCc may include a driving transistor Tdr that is connected between the first power supply line PL1 and the node N and generates the driving current Id according to the data voltage DATA. The pixel circuit PCc may include a first switching transistor Tsw that is connected between the data line DL and the gate electrode of the driving transistor Tdr and controlled by the first scan signal SCAN1. The pixel circuit PCc may include a storage capacitor Cst that is connected between the gate electrode of the driving transistor Tdr and the node N and stores the data voltage DATA for one frame period. The pixel circuit PCc may include a second switching transistor Tsw2 that is connected between the third power supply line PL3 that carries the reference voltage Vref and the node N. The second switching transistor Tsw2 may be controlled by the second scan signal SCAN2.

According to various embodiments, the pixel PX may include one of the light-emitting circuit ECa shown in FIG. 5A and the light-emitting circuit ECb shown in FIG. 6A and may include one of the pixel circuits PCa, PCb, and PCc shown in FIGS. 7A to 7C.

Figure 8A:
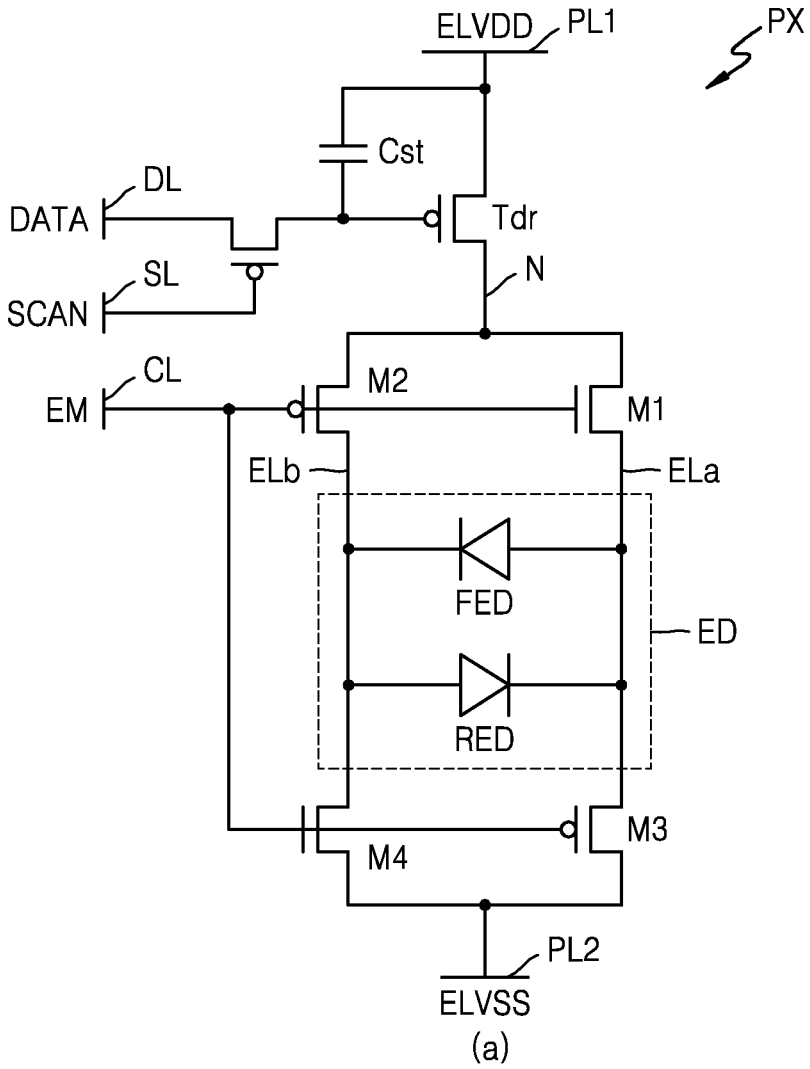
FIG. 8A is a circuit diagram of a pixel according to an embodiment.
Figure 8B:
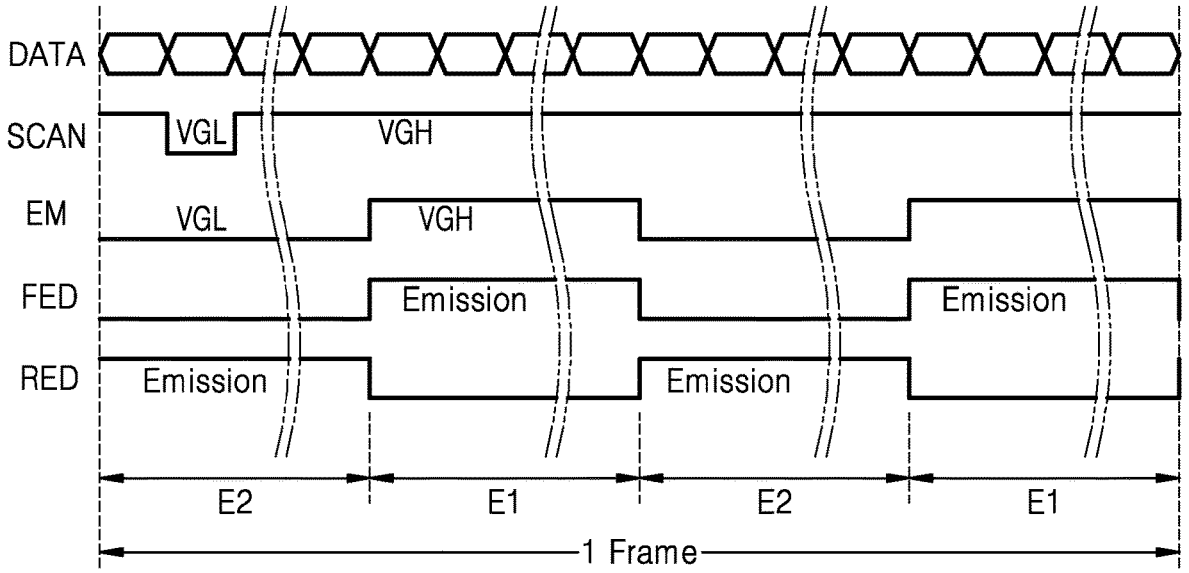
FIG. 8B is a timing diagram of the pixel of FIG. 8A.

FIG. 8A is a circuit diagram of a pixel PX according to an embodiment, and FIG. 8B is a timing diagram of the pixel PX of FIG. 8A.

Referring to FIG. 8A, the pixel PX includes the pixel circuit PCa shown in FIG. 7A, the light-emitting circuit ECa shown in FIG. 5A, and a light-emitting portion ED.

Referring to FIG. 8B, the data voltage DATA is received by the pixel circuit PCa when the scan signal SCAN has a turn-on level (e.g., a low level VGL). The storage capacitor Cst of the pixel circuit PCa may store the data voltage DATA for one frame period '1 Frame'. The pixel circuit PCa may generate a driving current Id according to the received data voltage DATA and output the generated driving current Id to the node N.

The control signal EM may have a first logic level (e.g., a high level VGH) during a first emission period E1 and a second logic level (e.g., the low level VGL) during a second emission period E2. During the first emission period E1, a first light-emitting device FED may emit light as the driving current Id flows through the first transistor M1, the first light-emitting device FED, and the fourth transistor M4. During the second emission period E2, a second light-emitting device RED may emit light as the driving current Id flows through the second transistor M2, the second light-emitting device RED, and the third transistor M3.

Figure 9:
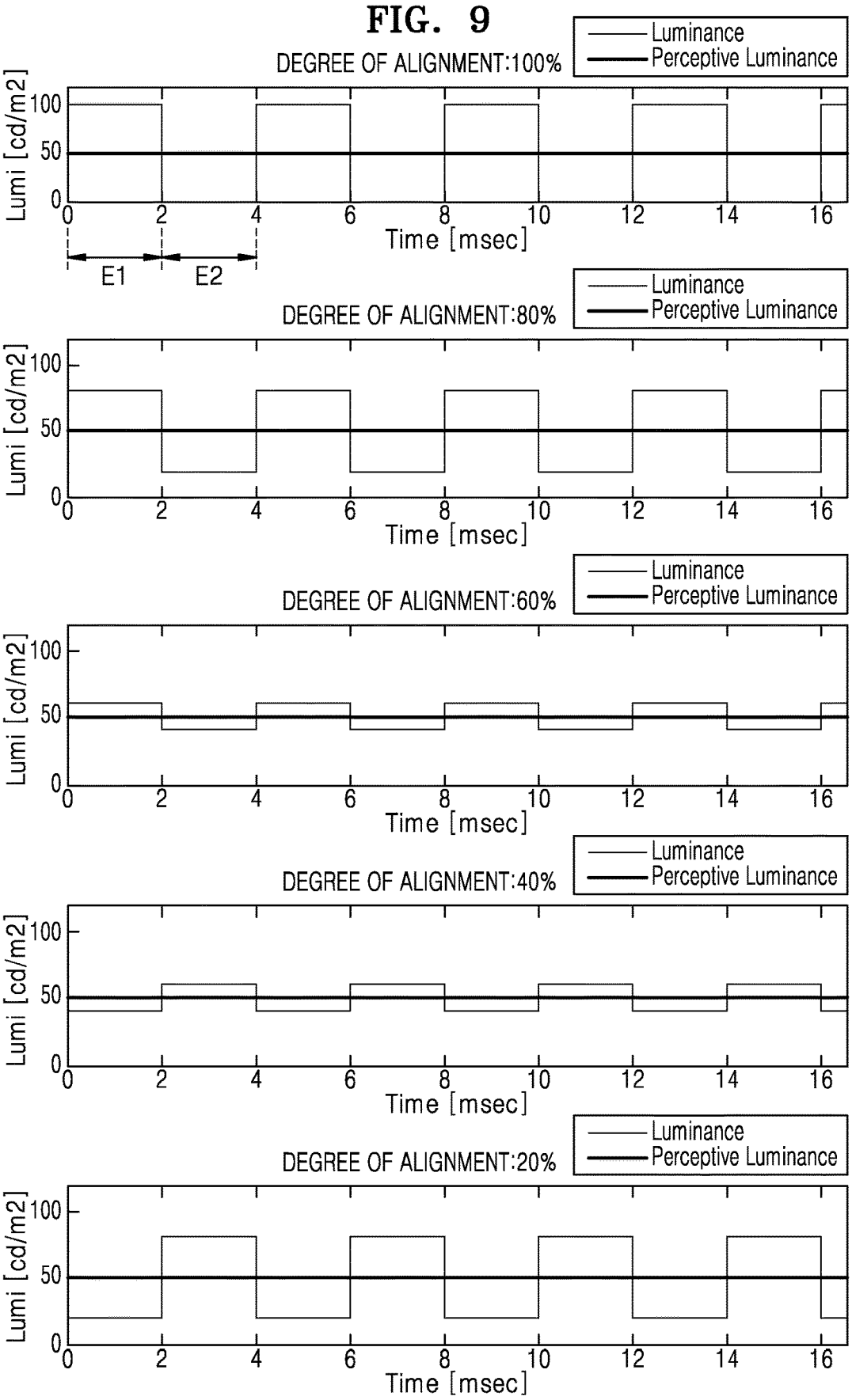
FIG. 9 shows graphs illustrating perceptive luminance of pixels with different degrees of alignment, according to various embodiments.

FIG. 9 illustrates graphs illustrating perceptive luminance of pixels with different degrees of alignment according to various embodiments.

A degree of alignment represents a ratio of the first light-emitting devices connected in the forward direction to all the light-emitting devices included in the pixel PX. When the degree of alignment is 100%, it indicates that all the light-emitting devices in the pixel PX are connected in the forward direction between the first electrode ELa and the second electrode ELb. When the degree of alignment is 80%, it indicates that 80% of the light-emitting devices in the pixel PX are connected in the forward direction between the first electrode ELa and the second electrode ELb, and the remaining 20% of the light-emitting devices are connected in the reverse direction between the first electrode ELa and the second electrode ELb.

The first light-emitting devices (i.g. the first light-emitting devices nLED_F in FIG. 3) that are connected in the forward direction emit light in the first emission period E1, and the second light-emitting devices (i.e., the second light-emitting devices nLED_R in FIG. 3) that are connected in the reverse direction emit light in the second emission period E2.

When the degree of alignment is 100%, the relative luminance (in the 0 to 100 scale) in the first emission period E1 is 100 because all the light-emitting devices emit light in the first emission period E1, and the relative luminance in the second emission period E2 is 0 because none of the light-emitting devices emit light in the second emission period E2. When the length of the first emission period E1 and the length of the second emission period E2 are equal to each other, the perceptive luminance perceived by a viewer is 50 (in the 0 to 100 scale).

When the degree of alignment is 80%, the relative luminance in the first emission period E1 is 80 because 80% of the light-emitting devices emit light in the first emission period E1, and the relative luminance in the second emission period E2 is 20 because 20% of the light-emitting devices emit light in the second emission period E2. Thus, the perceptive luminance perceived by a viewer is 50.

When the degree of alignment is 60%, the relative luminance in the first emission period E1 is 60 because 60% of the light-emitting devices emit light in the first emission period E1, and the relative luminance in the second emission period E2 is 40 because 40% of the light-emitting devices emit light in the second emission period E2. In this case, the perceptive luminance is 50.

When the degree of alignment is 40%, the relative luminance in the first emission period E1 is 40 because 40% of the light-emitting devices emit light in the first emission period E1, and the relative luminance in the second emission period E2 is 60 because 60% of the light-emitting devices emit light in the second emission period E2. In this case, the perceptive luminance is 50.

When the degree of alignment is 20%, the relative luminance in the first emission period E1 is 20 because 20% of the light-emitting devices emit light in the first emission period E1, and the relative luminance in the second emission period E2 is 80 because 80% of the light-emitting devices emit light in the second emission period E2. In this case, the perceptive luminance is 50.

Thus, according to various embodiments, not only the light-emitting devices that are connected in the forward direction between the first electrode ELa and the second electrode ELb but also the light-emitting devices that are connected in the reverse direction between the first electrode ELa and the second electrode ELb emit light, and thus the perceptive luminance perceived by a viewer may be maintained constant, such that the luminance uniformity of the display device may be improved.

According to various embodiments, in a display device in which some of the micro LEDs therein are arranged in the reverse direction between a pair of electrodes, micro LEDs that are arranged in the reverse direction also emit light and thus the uniformity of the perceptive luminance may be improved.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims.

What is claimed is:

1. A display device comprising:

a display unit including a plurality of pixels arranged in a first direction and a second direction;

a scan driver configured to transmit scan signals to the plurality of pixels through a plurality of scan lines;

a data driver configured to transmit data voltages to the plurality of pixels through a plurality of data lines;

a control driver configured to transmit a control signal to the plurality of pixels through a control line; and a voltage generator configured to supply a first driving voltage and a second driving voltage to the plurality of pixels through a first power supply line and a second power supply line, respectively, wherein each of the pixels comprises:

a light-emitting portion including first light-emitting devices that are connected in a forward direction between a first electrode and a second electrode and second light-emitting devices that are connected in a reverse direction between the first electrode and the second electrode;

a pixel circuit configured to receive a corresponding data voltage among the data voltages in synchronization with a corresponding scan signal among the scan signals, generate a driving current based on the corresponding data voltage, and output the driving current to a first node; and a light-emitting circuit configured to be controlled by the control signal, provide the driving current to the first light-emitting devices during a first emission period within one frame period when an image of one frame is displayed through the pixels of the display unit, and provide the driving current to the second light-emitting devices during a second emission period within the same frame period.

2. The display device of claim 1, wherein the first and second light-emitting devices comprise micro light-emitting diodes (LEDs), wherein each of the first light-emitting devices has an anode connected to the first electrode and a cathode connected to the second electrode, and wherein each of the second light-emitting devices has an anode connected to the second electrode and a cathode connected to the first electrode.

3. A display device comprising:

a display unit including a plurality of pixels arranged in a first direction and a second direction;

a scan driver configured to transmit scan signals to the plurality of pixels through a plurality of scan lines;

a data driver configured to transmit data voltages to the plurality of pixels through a plurality of data lines;

a control driver configured to transmit a control signal to the plurality of pixels through a control line; and a voltage generator configured to supply a first driving voltage and a second driving voltage to the plurality of pixels through a first power supply line and a second power supply line, respectively, wherein each of the pixels comprises:

a light-emitting portion including first light-emitting devices that are connected in a forward direction between a first electrode and a second electrode and second light-emitting devices that are connected in a reverse direction between the first electrode and the second electrode;

a pixel circuit configured to receive a corresponding data voltage among the data voltages in synchronization with a corresponding scan signal among the scan signals, generate a driving current based on the corresponding data voltage, and output the driving current to a first node; and a light-emitting circuit configured to be controlled by the control signal, provide the driving current to the first light-emitting devices during a first emission period, and provide the driving current to the second light-emitting devices during a second emission period, and wherein a ratio of a number of second light-emitting devices to a number of first light-emitting devices included in each of the pixels is not constant.

4. The display device of claim 1, wherein each of the pixels emits light alternately between a plurality of first emission periods and a plurality of second emission periods for one frame period.

5. The display device of claim 1, wherein the light-emitting circuit comprises:

a first transistor connected between the first node and the first electrode;

a second transistor connected between the first node and the second electrode;

a third transistor connected between the first electrode and the second power supply line; and a fourth transistor connected between the second electrode and the second power supply line.

6. The display device of claim 5, wherein a conductivity type of the first and fourth transistors is opposite to a conductivity type of the second and third transistors, and wherein gate electrodes of the first to fourth transistors are connected to the control line in common.

7. The display device of claim 6, wherein the control driver is configured to:

output the control signal having a first logic level to the control line such that, during the first emission period, the first and fourth transistors are turned on, and the second and third transistors are turned off, and the driving current flows through the first light-emitting devices, and output the control signal having a second logic level to the control line such that, during the second emission period, the second and third transistors are turned on, and the first and fourth transistors are turned off, and the driving current flows through the second light-emitting devices.

8. The display device of claim 7, wherein the control driver is further configured to alternately output the control signal having the first logic level and the control signal having the second logic level a plurality of times during one frame period.

9. The display device of claim 5, wherein the control line comprises a first control line for transmitting a first control signal to the plurality of pixels and a second control line for transmitting a second control signal to the plurality of pixels, and wherein gate electrodes of the first and fourth transistors are connected to the first control line in common and gate electrodes of the second and third transistors are connected to the second control line in common.

10. The display device of claim 9, wherein the control driver is further configured to:

output the first control signal having a turn-on level to the first control line and the second control signal having a turn-off level to the second control line, during the first emission period, and output the second control signal having the turn-on level to the second control line and the first control signal having the turn-off level to the first control line, during the second emission period.

11. The display device of claim 10, wherein the control driver is further configured to output the first control signal having the turn-on level with a first duty ratio and the second control signal having the turn-on level with a second duty ratio to the light-emitting circuit of each of the pixels.

12. The display device of claim 11, wherein the first duty ratio of the first control signal and the second duty ratio of the second control signal are adjusted through the control driver to control brightness of the display unit.

13. A pixel connected to a scan line for receiving a scan signal, a data line for receiving a data voltage, a control line for receiving a control signal, a first power supply line for receiving a first driving voltage, and a second power supply line for receiving a second driving voltage, the pixel comprising:

a light-emitting portion including first light-emitting devices that are connected in a forward direction between a first electrode and a second electrode and second light-emitting devices that are connected in a reverse direction between the first electrode and the second electrode;

a pixel circuit configured to receive the data voltage in synchronization with the scan signal, generate a driving current from the first driving voltage supplied from the first power supply line based on the data voltage, and output the driving current to a first node; and a light-emitting circuit configured to be controlled by the control signal, provide the driving current to the first light-emitting devices during a first emission period within one frame period when an image of one frame is displayed, and provide the driving current to the second light-emitting devices during a second emission period within the same frame period, the light-emitting circuit being connected to the first and second electrodes, the first node, the second power supply line, and the control line.

14. The pixel of claim 13, wherein the light-emitting circuit comprises:

a first transistor connected between the first node and the first electrode;

a second transistor connected between the first node and the second electrode;

a third transistor connected between the first electrode and the second power supply line; and a fourth transistor connected between the second electrode and the second power supply line.

15. The pixel of claim 14, wherein gate electrodes of the first to fourth transistors are connected to the control line in common, and wherein the first and fourth transistors are transistors of a first conductivity type and the second and third transistors are transistors of a second conductivity type that is different from the first conductivity type.

16. The pixel of claim 14, wherein, during the first emission period, the first and fourth transistors are turned on, and the second and third transistors are turned off, in response to the control signal having a first logic level, such that the driving current flows through the first light-emitting devices, and wherein, during the second emission period, the second and third transistors are turned on, and the first and fourth transistors are turned off, in response to the control signal having a second logic level, such that the driving current flows through the second light-emitting devices.

17. The pixel of claim 14, wherein the control line comprises a first control line for providing a first control signal to the pixel and a second control line for providing a second control signal to the pixel, and wherein gate electrodes of the first and fourth transistors are connected to the first control line in common, and gate electrodes of the second and third transistors are connected to the second control line in common.

18. The pixel of claim 17, wherein, during the first emission period, the first and fourth transistors are turned on in response to the first control signal having a turn-on level, and the second and third transistors are turned off in response to the second control signal having a turn-off level, and thus the driving current flows through the first light-emitting devices, and wherein, during the second emission period, the second and third transistors are turned on in response to the second control signal having a turn-on level, and the first and fourth transistors are turned off in response to the first control signal having a turn-off level, and thus the driving current flows through the second light-emitting devices.

19. The pixel of claim 13, wherein the pixel circuit comprises:

a driving transistor connected between the first power supply line and the first node, the driving transistor generating the driving current according to the data voltage;

a first switching transistor connected between the data line and a gate electrode of the driving transistor, the first switching transistor being controlled by the scan signal; and a storage capacitor connected to the gate electrode of the driving transistor, the storage capacitor storing the data voltage for one frame period.

20. The pixel of claim 19, wherein the pixel circuit further comprises a second switching transistor connected between a third power supply line for carrying a reference voltage and the first node, and wherein the storage capacitor is connected between the gate electrode of the driving transistor and the first node.

* * * * *